US011592176B2

(12) United States Patent
Kim et al.

(10) Patent No.: US 11,592,176 B2
(45) Date of Patent: Feb. 28, 2023

(54) RPM CONTROL METHOD FOR INDUCER FOR GAS FURNACE

(71) Applicant: LG ELECTRONICS INC., Seoul (KR)

(72) Inventors: Jusu Kim, Seoul (KR); Doyong Ha, Seoul (KR); Yongki Jeong, Seoul (KR); Janghee Park, Seoul (KR); Hansaem Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 273 days.

(21) Appl. No.: 16/940,581

(22) Filed: Jul. 28, 2020

(65) Prior Publication Data

US 2021/0215340 A1 Jul. 15, 2021

(30) Foreign Application Priority Data

Jul. 30, 2019 (KR) ..... 10-2019-0092705

(51) Int. Cl.

| | |
|---|---|
| ***F23N 3/08*** | (2006.01) |
| ***F04D 27/00*** | (2006.01) |
| ***F24H 3/06*** | (2022.01) |
| ***F24H 9/20*** | (2022.01) |

(52) U.S. Cl.

CPC ..... *F23N 3/085* (2013.01); *F04D 27/00* (2013.01); *F24H 3/065* (2013.01); *F24H 9/2085* (2013.01); *F23N 2223/30* (2020.01); *F23N 2225/04* (2020.01); *F23N 2233/04* (2020.01); *F23N 2241/02* (2020.01)

(58) Field of Classification Search

USPC ..... 237/12

See application file for complete search history.

(56) References Cited

U.S. PATENT DOCUMENTS

| | | | | |
|---|---|---|---|---|
| 4,703,747 | A * | 11/1987 | Thompson | F23N 1/025 236/15 C |
| 2002/0052713 | A1* | 5/2002 | Abraham | F23N 1/002 702/183 |
| 2009/0044794 | A1* | 2/2009 | Hugghins | F23N 5/242 126/116 A |

* cited by examiner

*Primary Examiner* — Steven B McAllister
*Assistant Examiner* — John E Bargero
(74) *Attorney, Agent, or Firm* — Ked & Associates

(57) ABSTRACT

Provided is an RPM control method for an inducer for a gas furnace that induces a flow of combustion gas produced in a burner from a heat exchanger to an exhaust pipe. The RPM control method for an inducer for a gas furnace includes: (a) initiating a heating operation for the gas furnace; (b) determining whether the operation time during which the heating operation is performed is equal to or longer than a first time period; (c) if it is determined that the operation time is equal to or longer than the first time period, detecting whether a pressure switch is turned OFF; and (d) if the pressure switch is detected as turned OFF, increasing the RPM of the inducer by a first value.

17 Claims, 4 Drawing Sheets

RPM CONTROL METHOD FOR INDUCER FOR GAS FURNACE

CROSS-REFERENCE TO RELATED APPLICATION

This application claims the priority from Korean Patent Application No. 10-2019-0092705, filed on Jul. 30, 2019, in the Korean Intellectual Property Office, the disclosure of which is incorporated herein by reference in its entirety.

FIELD OF THE DISCLOSURE

The present disclosure relates to an RPM control method for an inducer for a gas furnace. More particularly, the present disclosure relates to an RPM control method for an inducer for a gas furnace, that is capable of RPM control for an inducer in response to varying exhaust load.

RELATED ART

Generally, a gas furnace is an apparatus that heats up a room by supplying air heated through heat exchange with a flame and high-temperature combustion gas produced by the combustion of a fuel gas.

An inducer provided in such a gas furnace induces a flow of combustion gas produced in a burner from a heat exchanger to an exhaust pipe. In this case, the operation load on the inducer may be proportional to the operation capacity of the gas furnace. That is, the operation load on the inducer may be increased with the increasing operation capacity of the gas furnace, so as to prevent a flame produced by a burner from flowing backward and allow the combustion gas to smoothly move through the heat exchanger and the exhaust pipe.

Moreover, the operation load on the inducer may be proportional to the exhaust load if the operation capacity of the gas furnace is constant. That is, if the exhaust load increases due to foreign material clogging the exhaust pipe or other reasons, the operation load on the inducer may be increased so that a pressure as low as the set pressure is formed at the front end of the inducer.

A gas furnace according to the related art detects a rise in pressure at the front end of the inducer caused by an increase in exhaust load, by means of a pressure switch installed at the front end of the inducer, and performs control to increase the operation load on the inducer upon detecting that the pressure at the front end of the inducer is higher than a set value.

However, the gas furnace according to the related art does not provide a method for controlling the operation load on the inducer in response to varying exhaust load, such as decreasing the operation load on the inducer when the exhaust load becomes smaller again, which results in consuming more electric power than is required for the inducer and generating noise due to the overload operation.

SUMMARY OF THE DISCLOSURE

A first problem to be solved by the present disclosure is to provide an RPM control method for an inducer for a gas furnace, that is capable of RPM control for an inducer in response to varying exhaust load.

A second problem to be solved by the present disclosure is to provide an RPM control method for an inducer for a gas furnace, that is capable of preventing overshooting the exhaust load by too much by adjusting the operation load on the inducer up and down by degrees.

Technical problems to be solved by the present disclosure are not limited to the above-mentioned technical problems, and other technical problems not mentioned herein may be clearly understood by those skilled in the art from description below.

The present disclosure provides an RPM control method for an inducer for a gas furnace that induces a flow of combustion gas produced in a burner from a heat exchanger to an exhaust pipe.

To solve the above-mentioned problems, an RPM control method for an inducer for a gas furnace according to the present disclosure includes: (a) initiating a heating operation for the gas furnace; (b) determining whether the operation time during which the heating operation is performed is equal to or longer than a first time period; (c) if it is determined that the operation time is equal to or longer than the first time period, detecting whether a pressure switch is turned OFF; and (d) if the pressure switch is detected as turned OFF, increasing the RPM of the inducer by a first value.

The pressure switch may be turned ON if the pressure at the front end of the inducer is equal to or lower than a predetermined value and turned OFF if the pressure at the front end of the inducer exceeds the predetermined value.

In some embodiments, the RPM control method may further include: (e) if the pressure switch is detected as turned ON, determining whether the operation time is equal to or longer than a second time period which is longer than the first time period; and (f) if it is determined that the operation time is equal to or longer than the second time period, decreasing the RPM of the inducer by a second value.

The pressure switch may include a plurality of pressure switches with different predetermined values, and the step (c) may include: (c1) detecting the capacity for the heating operation; and (c2) determining whether a pressure switch corresponding to the heating operation capacity, among the plurality of pressure switches, is turned OFF.

The plurality of pressure switches may include a low-pressure switch with a first predetermined value, a mid-pressure switch with a second predetermined value lower than the first predetermined value, and a high-pressure switch with a third predetermined value lower than the second predetermined value.

The step (c2) may include determining whether the low-pressure switch is turned OFF if the heating operation capacity is within a first capacity range, determining whether the mid-pressure switch is turned OFF if the heating operation capacity is within a second capacity range greater than the first capacity range, and determining whether the high-pressure switch is turned OFF if the heating operation capacity is within a third capacity range greater than the second capacity range.

Means for solving other problems not mentioned above will be easily deduced from the descriptions of embodiments of the present disclosure.

DESCRIPTION OF EXEMPLARY EMBODIMENTS

Figure 1:
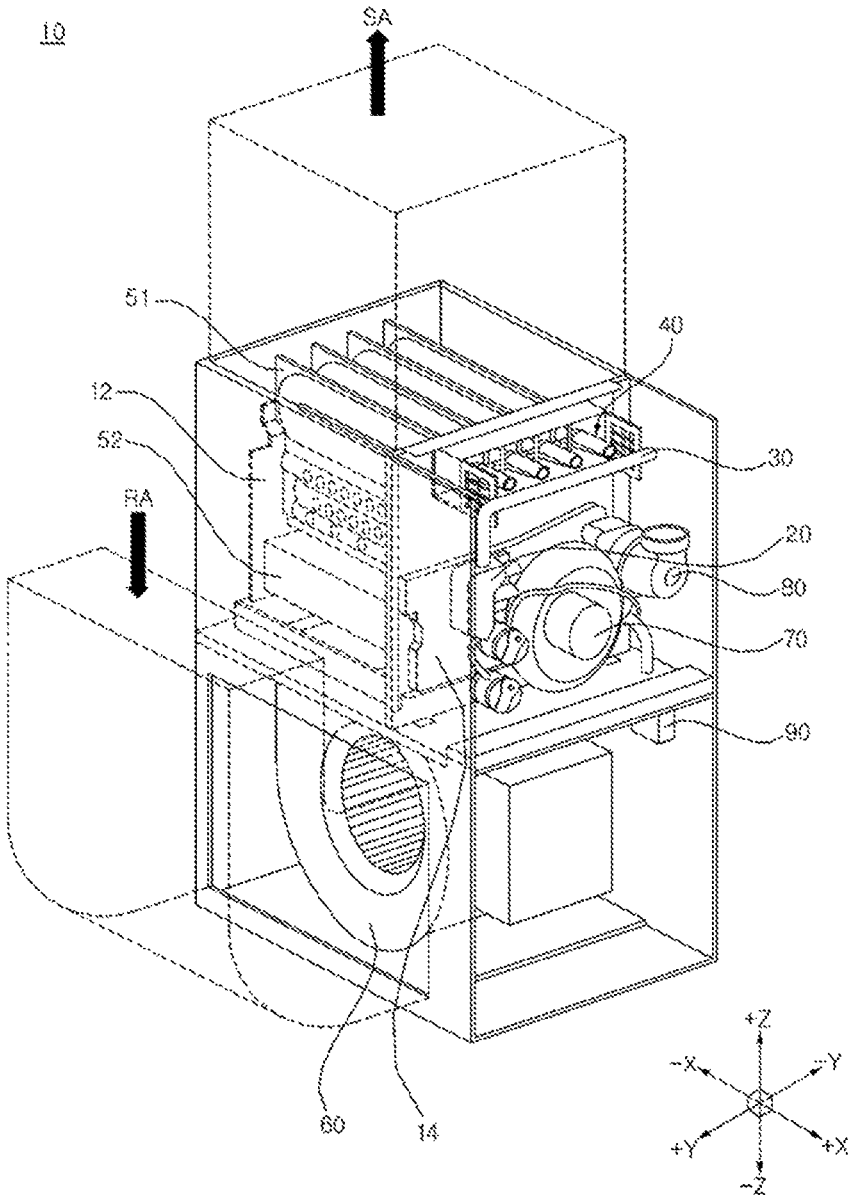
FIG. 1 is a perspective view of a gas furnace to which an RPM control method for an inducer for a gas furnace according to an exemplary embodiment of the present disclosure is applied.

Advantages and features of the present disclosure and methods for achieving them will be made clear from embodiments described below in detail with reference to the accompanying drawings. The present disclosure may, however, be embodied in many different forms and should not be construed as being limited to the embodiments set forth herein. Rather, these embodiments are provided so that this disclosure will be thorough and complete, and will fully convey the scope of the disclosure to those skilled in the art. The present disclosure is merely defined by the scope of the claims. Like reference numerals refer to like elements throughout the specification.

The present disclosure will be described with respect to a spatial orthogonal coordinate system illustrated in FIG. 1 where X, Y, and Z axes are orthogonal to each other. In this specification, the X axis, Y axis, and Z axis are defined assuming that the up-down direction is along the Z axis and the front-back direction is along the X axis. Each axis direction (X-axis direction, Y-axis direction, and Z-axis direction) refers to two directions in which each axis runs. Each axis direction with a '+' sign in front of it (+X-axis direction, +Y-axis direction, and +Z-axis direction) refers to a positive direction which is one of the two directions in which each axis runs. Each axis direction with a '−' sign in front of it (−X-axis direction, −Y-axis direction, and −Z-axis direction) refers to a negative direction which is the other of the two directions in which each axis runs.

Hereinafter, a gas furnace according to an exemplary embodiment of the present disclosure will be described with reference to FIG. 1.

FIG. 1 is a perspective view of a gas furnace to which an RPM control method for an inducer for a gas furnace according to an exemplary embodiment of the present disclosure is applied.

Generally, a gas furnace is an apparatus that heats up a room by supplying air heated through heat exchange with a flame and high-temperature combustion gas P produced by the combustion of a fuel gas R.

Referring to FIG. 1, the gas furnace 10 according to the exemplary embodiment of the present disclosure includes a gas valve 20 that supplies a fuel gas R to a manifold 30, a burner 40 in which the fuel gas R released from the manifold 30 is mixed with air and flows in an air-fuel mixture, and a heat exchanger 50 through which a combustion gas P produced by the combustion of the air-fuel mixture in the burner 40 flows.

Furthermore, the gas furnace 10 include an inducer 70 for inducing a flow of combustion gas P to an exhaust pipe 80 through the heat exchanger 50, a blower 60 for blowing air around the heat exchanger 50 so that the air is supplied to a room, and a condensate trap 90 for collecting a condensate produced in the heat exchanger 50 and/or the exhaust pipe 80 and discharging it.

The fuel gas R supplied through the gas valve 20 may include, for example, liquefied natural gas (LNG), which is natural gas that has been cooled down to liquid form, or liquefied petroleum gas (LPG), which is prepared by pressurizing gaseous by-products of petroleum refining into liquid form.

As the gas valve 20 opens or closes, the fuel gas R may be supplied to the manifold 30 or its supply may be cut off. Also, the amount of fuel gas R supplied to the manifold 30 may be regulated by adjusting the opening degree of the gas valve 20. As such, the gas valve 20 may regulate the heating power of the gas furnace 10. To this end, the gas furnace 10 may further include a controller for adjusting the opening or closing of the gas valve 20 or its opening degree.

The manifold 30 may guide the fuel gas R to the burner 40, and the fuel gas R, once introduced into the burner 40, may flow in a mixture with air.

The air-fuel mixture flowing through the burner 40 may be burnt due to ignition by an igniter. In this case, the combustion of the air-fuel mixture may produce a flame and a high-temperature combustion gas P.

The heat exchanger 50 may have a flow path through which the combustion gas P can flow. The gas furnace 10 according to the exemplary embodiment of the present disclosure may include a heat exchanger 50 including a primary heat exchanger 51 and a secondary heat exchanger 52 which are to be described later.

The primary heat exchanger 51 may be placed with one end being adjacent to the burner 40. The other end of the primary heat exchanger 51 opposite the one end may be attached to a coupling box 12. The combustion gas P flowing from one end of the primary heat exchanger 51 to the other end may be conveyed to the secondary heat exchanger 52 via the coupling box 12.

One end of the secondary heat exchanger 52 may be connected to the coupling box 12. The combustion gas P, once passed through the primary heat exchanger 51, may be introduced into one end of the secondary heat exchanger 52 and pass through the secondary heat exchanger 52. As such, the coupling box 12 is often referred to as a hot collect box (HCB) in that it guides combustion gases (P) of high temperature (around 180 to 220° C.) passed through the primary heat exchanger 51 to the secondary heat exchanger 52.

The secondary heat exchanger 52 may allow the combustion gas P passed through the primary heat exchanger 51 to exchange heat with the air passing around the secondary heat exchanger 52. That is the thermal energy of the combustion gas P passed through the primary heat exchanger 51 through the secondary heat exchanger 52 may be additionally used by means of the secondary heat exchanger 52, thereby improving the efficiency of the gas furnace 10.

The combustion gas P passed through the secondary heat exchanger 52 may condense through heat transfer to the air passing around the secondary heat exchanger 52, thereby producing a condensate. In other words, the vapor contained in the combustion gas P may condense and turn into condensate.

Due to this reason, the gas furnace 10 equipped with the primary heat exchanger 51 and secondary heat exchanger 52 is also called a condensing gas furnace. The produced condensate may be collected in a condensate collecting portion 14. To this end, the other end of the secondary heat exchanger 52 opposite the one end may be connected to one side of the condensate collecting portion 14.

An inducer 70 may be attached to the other side of the condensate collecting portion 14. The condensate collecting portion 14 may have an opening formed in it. The other end of the secondary heat exchanger 52 and the inducer 70 may communicate with each other via the opening formed in the condensate collecting portion 14.

That is, the combustion gas P passed through the other end of the secondary heat exchanger 52 may be released to the inducer 70 through the opening formed in the condensate collecting portion 14 and then discharged out of the gas furnace 10 through the exhaust pipe 80. As such, the condensate collecting portion 14 is often referred to as a cold collect box (CCB) in that it collects combustion gases (P) of relatively low temperature (around 40 to 60° C.) passed through the secondary heat exchanger 52 and guides them to the inducer 70.

The condensate produced in the secondary heat exchanger 52 may be released to the condensate trap 90 through the condensate collecting portion 14 and then discharged out of the gas furnace 10 through a discharge opening.

The condensate trap 90 may collect and discharge the condensate produced in the exhaust pipe 80 connected to the inducer 70, as well as the condensate produced in the secondary heat exchanger 52. That is, even a combustion gas P not condensed at the other end of the secondary heat exchanger 52 may condense to form a condensate as it passes through the exhaust pipe 80, then collect at the condensate trap 90, and then be discharged out of the gas furnace 10 through the discharge opening.

The inducer 70 may communicate with the other end of the secondary heat exchanger 52 via the opening formed in the condensate collecting portion 14. One end of the inducer 70 may be attached to the other side of the condensate collecting portion 14, and the other end of the inducer 70 may be attached to the exhaust pipe 80.

The inducer 70 may induce a flow of combustion gas P that passes through the primary heat exchanger 51, coupling box 12, and secondary heat exchanger 52 and is discharged to the exhaust pipe 80. In this regard, the inducer 70 may be understood as an induced draft motor (IDM).

The blower 60 for the gas furnace may be located at the bottom of the gas furnace 10. Air supplied to the room may move upward from the bottom of the gas furnace 10 by the blower 60. In this regard, the blower 60 may be understood as an indoor blower motor (IBM).

The blower 60 may allow air to pass around the heat exchanger 50. The air passing around the heat exchanger 50, blown by the blower 60, may have a temperature rise by receiving thermal energy from the high-temperature combustion gas P via the heat exchanger 50. The room may be heated as the higher-temperature air is supplied to the room.

The gas furnace 10 according to the exemplary embodiment of the present disclosure may include a casing. The components of the above-described gas furnace 10 may be accommodated inside the casing.

A lower opening may be formed in a side adjacent to the blower 60, at the bottom of the casing. A room air duct D1 through which air (hereinafter, "room air") RA coming from a room passes may be installed in the lower opening.

A supply air duct D2 through which air (hereinafter, "supply air") SA supplied to the room passes may be installed in an upper opening formed at the top of the casing. That is, when the blower 60 operates, the air coming from the room through the room air duct D1 to be used as the room air RA has a temperature rise as it passes through the heat exchanger 50, and the air may be supplied to the room through the supply air duct D2 and used as the supply air SA, thereby heating the room.

Hereinafter, an RPM control method for an inducer for a gas furnace according to an exemplary embodiment of the present disclosure will be described with reference to FIGS. 1 to 4.

Figure 2:
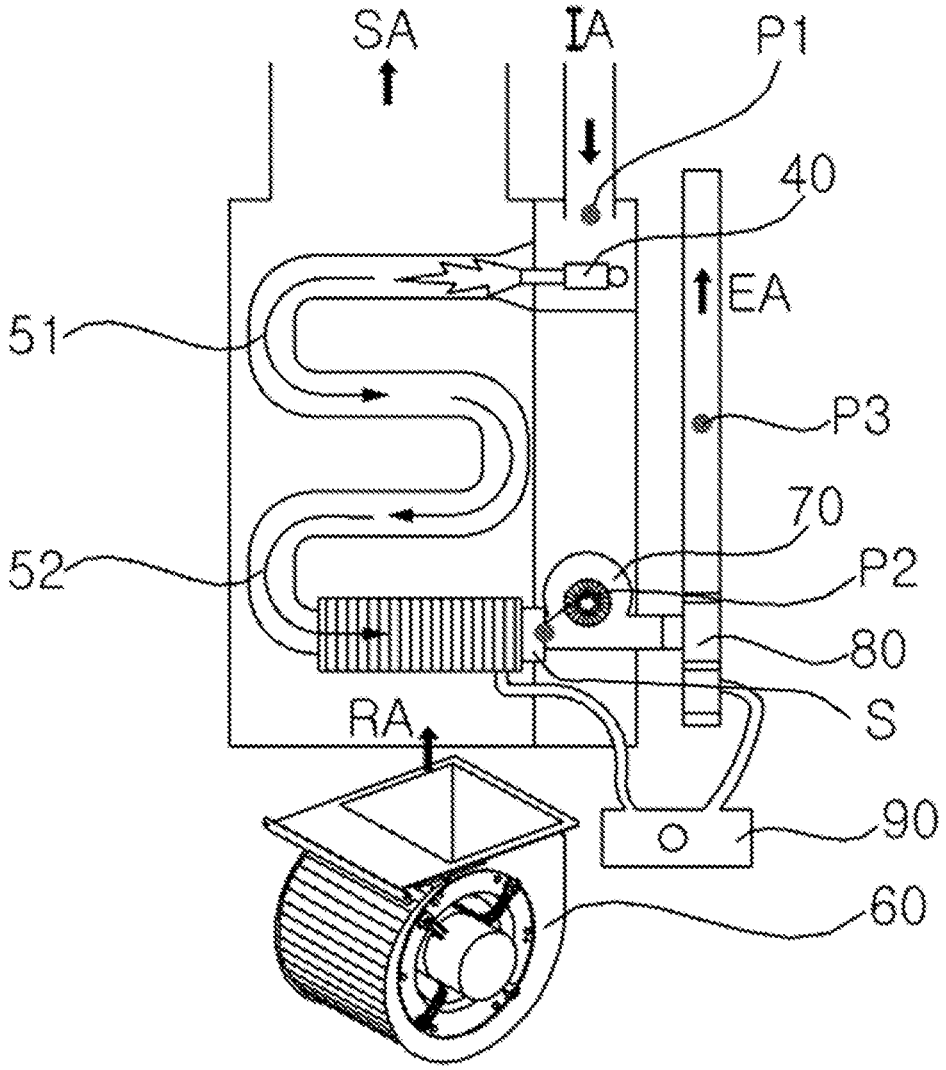
FIG. 2 is a view illustrating a pressure switch used for an RPM control method for an inducer for a gas furnace according to an exemplary embodiment of the present disclosure.

FIG. 2 is a view illustrating a pressure switch used for a RPM control method for an inducer for a gas furnace according to an exemplary embodiment of the present disclosure.

Referring to FIG. 2, the gas furnace 10 may include a pressure switch S. The pressure switch S may be located at the front end of the inducer 70. The pressure switch S may open and close an electrical contact depending on the difference between the pressure P1 of intake air IA supplied to the burner 40 and the pressure P2 at the front of the inducer 70. That is, if the difference between the pressure P1 of intake air IA supplied to the burner 40 and the pressure P2 at the front of the inducer 70 is equal to or greater than a reference value, the pressure switch S may be turned ON, and if the pressure difference is less than the reference value, the pressure switch S may be turned OFF.

Here, since the pressure P1 of intake air IA has a fixed value, the pressure switch S will be described as being turned ON if the pressure P2 at the front end of the inducer 70 is equal to or lower than a predetermined value and turned OFF if the pressure at the front end of the inducer exceeds the predetermined value. The construction of the pressure switch S which turns the electrical contact ON/OFF depending on the pressure difference is widely known, so a detailed description of the construction and operating principle will be omitted.

Because the inducer 70 has a lower pressure at the front end than at the back end, the pressure P2 at the front end of the inducer 70 may rise when the exhaust load increases due to foreign material clogging the exhaust pipe 80 through which exhaust gas EA flows. At this point, if the operation load on the inducer 70 remains the same before and after the increase in exhaust load, even though the heating operation capacity (i.e., heating power) of the gas furnace 10 is constant, the flame or combustion gas passing through the heat exchanger 50 may be exposed to the risk of flowing back toward the burner 40.

In view of this, in the present disclosure, the pressure switch S may be detected as turned OFF if the pressure P2 at the front end of the inducer 70 rises above the predetermined value with increasing exhaust load, and the operation load on the inducer 70 may be increased so that the pressure P2 at the front end of the inducer 70 becomes equal to or lower than the predetermined value, in order to bring the pressure switch S back to ON.

In addition, in the present disclosure, the pressure switch S may be detected as turned OFF if the pressure P2 at the front end of the inducer 70 rises above the predetermined value, even without an increase in exhaust load, because the operation load on the inducer 70 is lower than the heating capacity (i.e., heating power) of the gas furnace 10, and the operation load on the inducer 70 may be increased so that the pressure P2 at the front end of the inducer 70 becomes equal to or lower than the predetermined value, in order to bring the pressure switch S back to ON.

Figure 3:
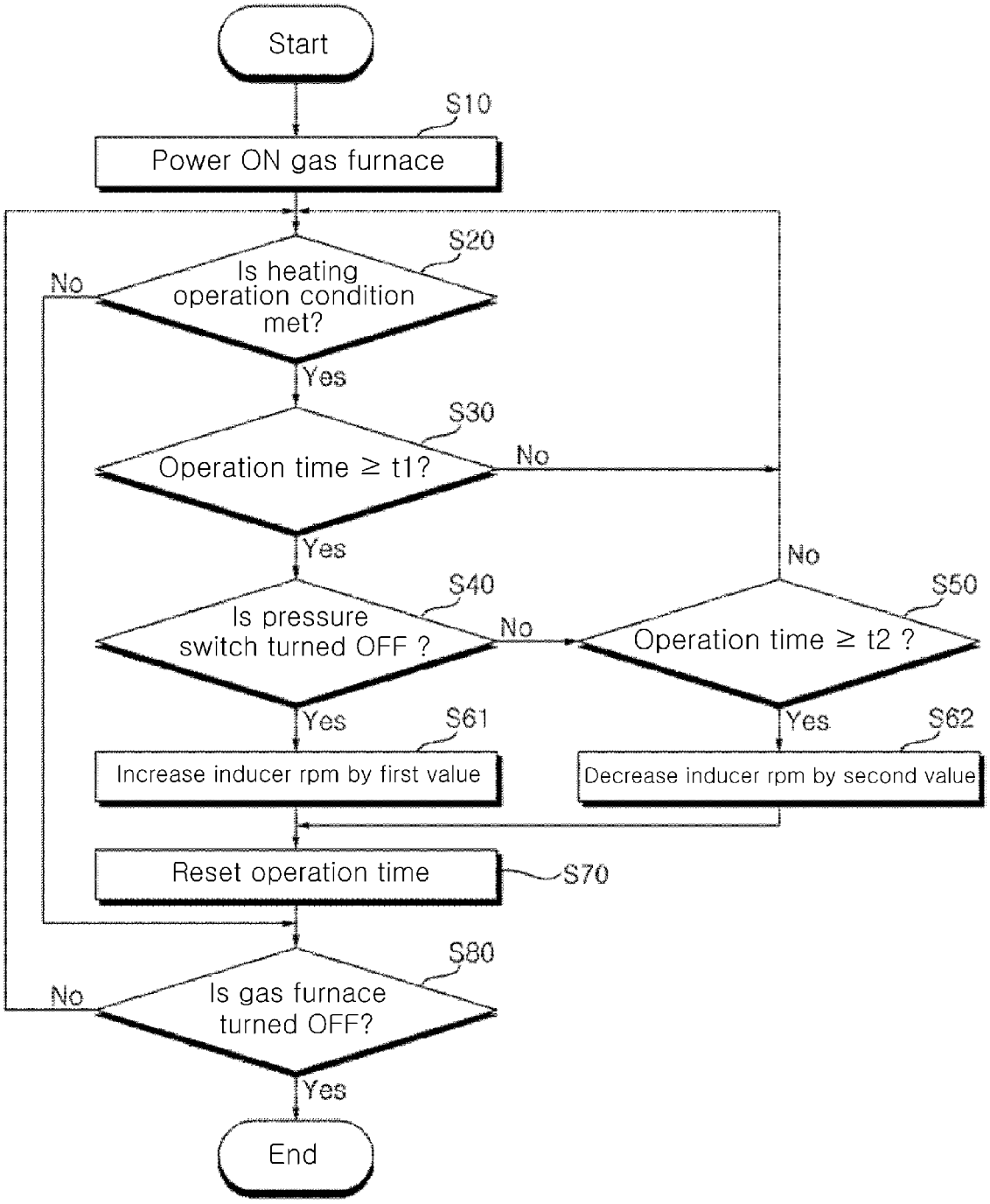
FIG. 3 is a flowchart of an RPM control method for an inducer for a gas furnace according to an exemplary embodiment of the present disclosure.

FIG. 3 is a flowchart of an RPM control method for an inducer for a gas furnace according to an exemplary embodiment of the present disclosure. Here, the steps of the control method to be described below may be performed by the controller.

Referring to FIG. 3, the control method for the gas furnace 10 may be performed after the step S10 of powering ON the gas furnace 10. When the gas furnace 10 is powered ON, the gas furnace 10 may be in operation or not in operation. Here, the expression "the gas furnace 10 in operation" means that a flame and high-temperature combustion gas P produced by the combustion of a fuel gas R introduced from the gas valve 20 and manifold 30 flows through the heat exchanger 50. On the other hand, the expression "the gas furnace 10 not in operation" means that the gas valve 20 blocks the fuel gas R from entering the manifold 30 or the burner 40.

After the step S10, the step S20 of determining whether a condition of heating operation is met may be performed. In the step S20, if the indoor temperature is lower than a set temperature entered by a person in the room, the condition of heating operation may be met. In some embodiments, the condition of heating operation may be met if a person in the room gives input for heating operation.

If it is determined that the condition of heating operation is met in the step S20, the step S30 of determining whether the time required for the heating operation (hereinafter, operation time) is equal to or longer than a first time period t1 may be performed. In an example, the first time period t1 may be 1 to 3 seconds.

If it is determined that the operation time is shorter than the first time period t1 in the step S30, the flow may return to the step S20. If it is determined that the operation time is equal to or longer than the first time period t1, the step S40 of determining whether the pressure switch S is turned OFF may be performed.

Furthermore, in relation to the step S40, the present disclosure may allow the pressure switch S to include a plurality of pressure switches with different predetermined values, considering that the pressure P2 at the front of the inducer 70 decreases as the load on the inducer 70 increases with the increasing heating operation capacity of the gas furnace 10. At this point, the step S40 may include the step S41 of detecting the capacity for the heating operation and the step S42 of determining whether a pressure switch corresponding to the heating operation capacity, among the plurality of pressure switches, is turned OFF.

The plurality of pressure switches may include a low-pressure switch, a mid-pressure switch, and a high-pressure switch. The low-pressure switch may be a switch with a first predetermined value, the mid-pressure switch may be a switch with a second predetermined value lower than the first predetermined value, and the high-pressure switch may be a switch with a third predetermined value lower than the second predetermined value.

In this case, the step S42 may include the step of determining whether the low-pressure switch is turned OFF if the heating operation capacity is within a first capacity range, determining whether the mid-pressure switch is turned OFF if the heating operation capacity is within a second capacity range greater than the first capacity range, and determining whether the high-pressure switch is turned OFF if the heating operation capacity is within a third capacity range greater than the second capacity range. In an example, the first capacity range may be 40 to 60% of the maximum operation capacity of the gas furnace 10, the second capacity range may be 60 to 80%, and the third capacity range may be 80 to 100%.

If the pressure switch S is detected as turned OFF in the step S40, the step S61 of increasing the RPM of the inducer 70 by a first value may be performed. In an example, the first value may be a value corresponding to 3 to 7% of the maximum RPM of the inducer 70. In another example, the first value may be a value corresponding to 250 to 350 RPM of the inducer 70. In some embodiments, the step S61 may employ various methods for increasing the RPM of the inducer 70.

If the pressure switch S is detected as turned ON (that is, not turned OFF) in the step S40, the step S50 of determining whether the operation time is longer than the second time period t2. The second time period t2 may be 15 to 45 times longer than the first time period t1. In an example, the second time period t2 may be 55 to 65 seconds.

If it is determined that the operation time is shorter than the second time period t2 in the step S50, the flow may return to the step S20. If it is determined that the operation time is longer than the second time period t2 in the step S50, the step S62 of decreasing the RPM of the inducer 70 by a second value may be performed. In an example, the second value may be a value corresponding to 0.5 to 1.5% of the maximum RPM of the inducer 70. In another example, the second value may be a value corresponding to 25 to 75 RPM of the inducer 70. In some embodiments, the step S62 may employ various methods for decreasing the RPM of the inducer 70.

After the step S61 or the step S62, the step S70 of resetting the operation time may be performed. After the step S70, the flow may return to the step S20 if the gas furnace 10 is still powered ON.

After the step S70, the step S80 of determining whether the gas furnace 10 is powered OFF may be performed. If it is determined that the gas furnace 10 is powered OFF in the step S80, the control method may be ended. On the other hand, if it is determined that the gas furnace 10 is not powered OFF, the flow may return to the step S20.

Figure 4A:
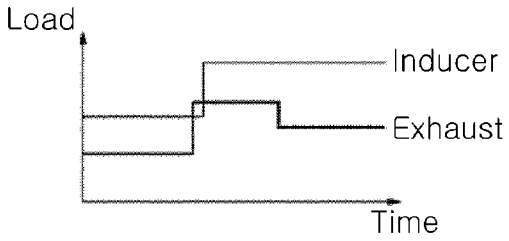
FIGS. 4A-4B are graphs comparing the related art and the present disclosure, in relation to an RPM control method for an inducer for a gas furnace.
Figure 4B:
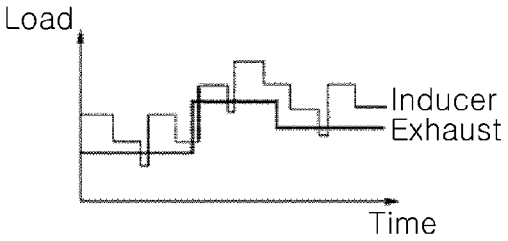

FIGS. 4A-4B are graphs comparing the related art and the present disclosure, in relation to an RPM control method for an inducer for a gas furnace.

Referring to FIG. 4A, the control method according to the related art does not provide any control to narrow the difference between the two types of load when the operation load on the inducer is greater than the exhaust load. In particular, this control method is problematic in that, when the operation load on the inducer becomes smaller than the exhaust load, the operation load on the inducer is increased by a large amount, but still remains increased even if the exhaust load becomes smaller again later, which results in consuming more electric power than is required for the inducer and generating noise due to the overload operation.

Referring to FIG. 4B, the present disclosure allows for increasing the RPM of the inducer 70 by a relatively large amount with the first time period t1, which is a relatively short time, if the pressure switch S is detected as turned OFF, and this prevents the flame or combustion gas P from flowing backward due to the lack of operation load on the inducer 70, thereby preventing safety risks. Moreover, the present disclosure allows for decreasing the RPM of the inducer 70 by a relatively small amount with the second time period t2, which is a relatively long time, if the pressure switch S is detected as turned ON, and therefore the operation load on the inducer 70 can be adjusted slowly and by degrees so that it can cope with the heating operation capacity and/or exhaust load of the gas furnace.

In the above, an RPM control method for an inducer for a gas furnace according to an exemplary embodiment of the present disclosure has been described with reference to the accompanying drawings. However, the present disclosure is not limited to the above embodiments, and it will be apparent to those skilled in the art that various modifications or implementations within the equivalent scopes can be made without departing from the subject matter of the present disclosure.

The present disclosure provides one or more of the following advantages.

Firstly, the operation load on the inducer can be adjusted in response to varying exhaust load by increasing the RPM of the inducer if the pressure at the front end of the inducer exceeds a predetermined value due to an increase in exhaust load and decreasing the RPM of the inducer if the pressure at the front end of the inducer remains equal to or lower than the predetermined value for a certain amount of time.

Secondly, the operation load on the inducer can be adjusted up and down by degrees by making a difference between the time taken to detect the pressure switch as turned OFF and the time taken to detect the pressure switch as turned ON and also making a difference between the amounts of increase and decrease of the RPM of the inducer, which are used as criteria for determining an increase or decrease in the RPM of the inducer.

What is claimed is:

1. A revolutions per minute (RPM) control method for an inducer for a gas furnace that induces a flow of combustion gas produced in a burner from a heat exchanger to an exhaust pipe, the RPM control method comprising: (a) initiating a heating operation for the gas furnace; (b) determining whether an operation time during which the heating operation is performed is equal to or longer than a first time period; (c) if it is determined that the operation time is equal to or longer than the first time period, detecting whether a pressure switch is turned OFF; (d) if the pressure switch is detected as turned OFF, increasing the RPM of the inducer by a first value; (e) if the pressure switch is detected as turned ON, determining whether the operation time is equal to or longer than a second time period which is longer than the first time period; and (f) if it is determined that the operation time is equal to or longer than the second time period, decreasing the RPM of the inducer by a second value, wherein the first value is a value corresponding to 3 to 7% of a maximum RPM of the inducer, and the second value is a value corresponding to 0.5 to 1.5% of the maximum RPM of the inducer.

2. The RPM control method of claim 1, wherein the pressure switch is turned ON if a pressure at an intake end of the inducer is equal to or lower than a predetermined value and turned OFF if the pressure at the intake end of the inducer exceeds the predetermined value.

3. The RPM control method of claim 1, wherein, if it is determined that the operation time is shorter than the first time period in the step (b) or that the operation time is shorter than the second time period in the step (e), the flow returns to the step (a).

4. The RPM control method of claim 1, wherein the second time period is 15 to 45 times longer than the first time period.

5. The RPM control method of claim 1, wherein the first value is a value corresponding to 250 to 350 RPM of the inducer, and the second value is a value corresponding to 25 to 75 RPM of the inducer.

6. The RPM control method of claim 2, wherein the pressure switch comprises a plurality of pressure switches with different predetermined values, and wherein the step (c) comprises:

(c1) detecting a capacity for the heating operation; and (c2) determining whether a pressure switch corresponding to the heating operation capacity, among the plurality of pressure switches, is turned OFF.

7. The RPM control method of claim 6, wherein the plurality of pressure switches comprise a low-pressure switch with a first predetermined value, a mid-pressure switch with a second predetermined value lower than the first predetermined value, and a high-pressure switch with a third predetermined value lower than the second predetermined value, and wherein the step (c2) comprises determining whether the low-pressure switch is turned OFF if the heating operation capacity is within a first capacity range, determining whether the mid-pressure switch is turned OFF if the heating operation capacity is within a second capacity range greater than the first capacity range, and determining whether the high-pressure switch is turned OFF if the heating operation capacity is within a third capacity range greater than the second capacity range.

8. A revolutions per minute (RPM) control method for an inducer for a gas furnace that induces a flow of combustion gas produced in a burner from a heat exchanger to an exhaust pipe, the RPM control method comprising:

(a) initiating a heating operation for the gas furnace;

(b) determining whether an operation time during which the heating operation is performed is equal to or longer than a first time period;

(c) if it is determined that the operation time is equal to or longer than the first time period, detecting whether a pressure switch is turned OFF;

(d) if the pressure switch is detected as turned OFF, increasing the RPM of the inducer by a first value;

(e) if the pressure switch is detected as turned ON, determining whether the operation time is equal to or longer than a second time period which is longer than the first time period; and (f) if it is determined that the operation time is equal to or longer than the second time period, decreasing the RPM of the inducer by a second value, wherein the second time period is 15 to 45 times longer than the first time period.

9. The RPM control method of claim 8, wherein the pressure switch is turned ON if a pressure at an intake end of the inducer is equal to or lower than a predetermined value and turned OFF if the pressure at the intake end of the inducer exceeds the predetermined value.

10. The RPM control method of claim 9, wherein the pressure switch comprises a plurality of pressure switches with different predetermined values, and wherein the step (c) comprises:

(c1) detecting a capacity for the heating operation; and (c2) determining whether a pressure switch corresponding to the heating operation capacity, among the plurality of pressure switches, is turned OFF.

11. The RPM control method of claim 10, wherein the plurality of pressure switches comprise a low-pressure switch with a first predetermined value, a mid-pressure switch with a second predetermined value lower than the first predetermined value, and a high-pressure switch with a third predetermined value lower than the second predetermined value, and wherein the step (c2) comprises determining whether the low-pressure switch is turned OFF if the heating operation capacity is within a first capacity range, determining whether the mid-pressure switch is turned OFF if the heating operation capacity is within a second capacity range greater than the first capacity range, and determining whether the high-pressure switch is turned OFF if the heating operation capacity is within a third capacity range greater than the second capacity range.

12. The RPM control method of claim 8, wherein, if it is determined that the operation time is shorter than the first time period in the step (b) or that the operation time is shorter than the second time period in the step (e), the flow returns to the step (a).

13. A revolutions per minute (RPM) control method for an inducer for a gas furnace that induces a flow of combustion gas produced in a burner from a heat exchanger to an exhaust pipe, the RPM control method comprising:

(a) initiating a heating operation for the gas furnace;

(b) determining whether an operation time during which the heating operation is performed is equal to or longer than a first time period;

(c) if it is determined that the operation time is equal to or longer than the first time period, detecting whether a pressure switch is turned OFF;

(d) if the pressure switch is detected as turned OFF, increasing the RPM of the inducer by a first value;

(e) if the pressure switch is detected as turned ON, determining whether the operation time is equal to or longer than a second time period which is longer than the first time period; and (f) if it is determined that the operation time is equal to or longer than the second time period, decreasing the RPM of the inducer by a second value, wherein the first value is a value corresponding to 250 to 350 RPM of the inducer, and the second value is a value corresponding to 25 to 75 RPM of the inducer.

14. The RPM control method of claim 13, wherein the pressure switch is turned ON if a pressure at an intake end of the inducer is equal to or lower than a predetermined value and turned OFF if the pressure at the intake end of the inducer exceeds the predetermined value.

15. The RPM control method of claim 14, wherein the pressure switch comprises a plurality of pressure switches with different predetermined values, and wherein the step (c) comprises:

(c1) detecting a capacity for the heating operation; and (c2) determining whether a pressure switch corresponding to the heating operation capacity, among the plurality of pressure switches, is turned OFF.

16. The RPM control method of claim 15, wherein the plurality of pressure switches comprise a low-pressure switch with a first predetermined value, a mid-pressure switch with a second predetermined value lower than the first predetermined value, and a high-pressure switch with a third predetermined value lower than the second predetermined value, and wherein the step (c2) comprises determining whether the low-pressure switch is turned OFF if the heating operation capacity is within a first capacity range, determining whether the mid-pressure switch is turned OFF if the heating operation capacity is within a second capacity range greater than the first capacity range, and determining whether the high-pressure switch is turned OFF if the heating operation capacity is within a third capacity range greater than the second capacity range.

17. The RPM control method of claim 13, wherein, if it is determined that the operation time is shorter than the first time period in the step (b) or that the operation time is shorter than the second time period in the step (e), the flow returns to the step (a).

* * * * *